US008872737B2

(12) United States Patent
Shin et al.

(10) Patent No.: US 8,872,737 B2
(45) Date of Patent: Oct. 28, 2014

(54) ORGANIC LIGHT EMITTING DEVICE, AND APPARATUS AND METHOD OF GENERATING MODIFICATION INFORMATION THEREFOR

(75) Inventors: Kyoung-Ju Shin, Hwaseong-si (KR); Chong-Chul Chai, Seoul (KR); Joon-Chul Goh, Hwaseong-si (KR)

(73) Assignee: Samsung Display Co., Ltd., Yongin (KR)

( * ) Notice: Subject to any disclaimer, the term of this patent is extended or adjusted under 35 U.S.C. 154(b) by 1416 days.

(21) Appl. No.: 12/483,049

(22) Filed: Jun. 11, 2009

(65) Prior Publication Data

US 2010/0103083 A1 Apr. 29, 2010

(30) Foreign Application Priority Data

Oct. 27, 2008 (KR) ..... 10-2008-0105359

(51) Int. Cl.

*G09G 3/30* (2006.01)
*G09G 3/32* (2006.01)
*G09G 3/20* (2006.01)

(52) U.S. Cl.

CPC ..... *G09G 3/3208* (2013.01); *G09G 2320/045* (2013.01); *G09G 2320/0693* (2013.01); *G09G 2360/147* (2013.01); *G09G 2320/029* (2013.01); *G09G 2320/0295* (2013.01); *G09G 2320/043* (2013.01); *G09G 2320/0285* (2013.01); *G09G 3/2092* (2013.01); *G09G 2360/16* (2013.01)

USPC ..... 345/76; 345/77; 345/89; 345/690

(58) Field of Classification Search

None

See application file for complete search history.

(56) References Cited

U.S. PATENT DOCUMENTS

| | | | | |
|---|---|---|---|---|
| 6,937,215 | B2 | 8/2005 | Lo | |
| 6,999,048 | B2 | 2/2006 | Sun et al. | |
| 7,355,574 | B1 * | 4/2008 | Leon et al. | 345/82 |

(Continued)

FOREIGN PATENT DOCUMENTS

| | | |
|---|---|---|
| JP | 2005-055722 | 3/2005 |
| JP | 2005-222030 | 8/2005 |
| JP | 2007-240694 | 9/2007 |
| JP | 2007-286341 | 11/2007 |
| KR | 100490624 | 5/2005 |
| KR | 100613088 | 8/2006 |
| KR | 100613091 | 8/2006 |

(Continued)

*Primary Examiner* — Jesus Hernandez

(74) *Attorney, Agent, or Firm* — H.C. Park & Associates, PLC

(57) ABSTRACT

An organic light emitting device including a display panel including a plurality of pixels respectively including a driving transistor and an organic light emitting element; a driving unit to supply a driving signal to the display panel; a signal controller to control the driving unit; a signal modification unit to modify an input image signal based on modification information to generate a modified image signal; and a modification controller to generate and provide the modification information to the signal modification unit. The signal modification unit includes a first modification unit to convert the input image signal into a first modified signal according to first modification information generated based on a characteristic deviation of the driving transistor, and a second modification unit to convert the first modified signal into a second modified signal according to second modification information generated based on a characteristic deviation of the organic light emitting element.

23 Claims, 14 Drawing Sheets

(56) References Cited

U.S. PATENT DOCUMENTS

| | | | | |
|---|---|---|---|---|
| 2003/0057895 | A1* | 3/2003 | Kimura | 315/370 |
| 2003/0103058 | A1* | 6/2003 | Elliott et al. | 345/589 |
| 2004/0174323 | A1* | 9/2004 | Yamashita et al. | 345/75.2 |
| 2005/0156834 | A1 | 7/2005 | Jo et al. | |
| 2005/0179625 | A1* | 8/2005 | Choi et al. | 345/76 |
| 2006/0244387 | A1* | 11/2006 | Park et al. | 315/169.1 |
| 2006/0257134 | A1* | 11/2006 | Huang | 396/287 |
| 2007/0285366 | A1* | 12/2007 | Ha et al. | 345/87 |
| 2008/0074361 | A1* | 3/2008 | Lee et al. | 345/77 |
| 2008/0204378 | A1* | 8/2008 | Park et al. | 345/77 |
| 2008/0224966 | A1* | 9/2008 | Cok et al. | 345/82 |
| 2009/0207106 | A1* | 8/2009 | Mizukoshi et al. | 345/76 |

FOREIGN PATENT DOCUMENTS

| | | |
|---|---|---|
| KR | 100688820 | 2/2007 |
| KR | 100692455 | 3/2007 |
| KR | 1020070057450 | 6/2007 |
| KR | 100613093 | 6/2009 |

* cited by examiner

ORGANIC LIGHT EMITTING DEVICE, AND APPARATUS AND METHOD OF GENERATING MODIFICATION INFORMATION THEREFOR

CROSS-REFERENCE TO RELATED APPLICATION

This application claims priority to and the benefit of Korean Patent Application No. 10-2008-0105359 filed in the Korean Intellectual Property Office on Oct. 27, 2008, which is hereby incorporated by reference for all purposes as if fully set forth herein.

BACKGROUND

1. Field of the Invention

The present disclosure relates to an organic light emitting device, and an apparatus and a method for generating modification information thereof.

2. Description of the Related Art

Recently, flat panel displays such as a liquid crystal display and an organic light emitting device have actively been developed.

An organic light emitting device uses an organic light emitting element and a driving transistor as core elements, and the display quality changes according to spatial or temporal characteristic deviations thereof. Examples of the characteristic deviation of the driving transistor that presently generate problems include having different threshold voltages according to positions of the transistors, and having the threshold voltage change over time. Recently, mobility deviation of the transistor has become an issue.

To reduce the characteristic deviations, a method for compensating per pixel by forming a compensation circuit in the pixel has been examined. However, additional elements and additional wiring are used for this compensation method, thereby complicating the pixel circuit. Accordingly, the yield may decrease, the cost increases, and deterioration of display quality may still occur depending on conditions.

SUMMARY

An embodiment of the present invention reduces the characteristic deviations of the display device without a compensation circuit for each pixel.

Additional features of the invention will be set forth in the description which follows, and in part will be apparent from the description, or may be learned by practice of the invention.

An organic light emitting device according to an exemplary embodiment of the present invention includes a display panel including a plurality of pixels respectively including a driving transistor and an organic light emitting element; a driving unit to supply a driving signal to the display panel; a signal controller to control the driving unit; a signal modification unit to modify an input image signal based on modification information to generate a modified image signal; and a modification controller to generate and provide the modification information to the signal modification unit. The signal modification unit includes a first modification unit to convert the input image signal into a first modified signal according to the first modification information generated based on a characteristic deviation of the driving transistor, and a second modification unit to convert the first modified signal into a second modified signal according to a second modification information generated based on a characteristic deviation of the organic light emitting element.

The first modification information may be obtained by measuring the output current of the driving transistor and comparing the output current with a target current.

The first modification information may be obtained by grouping the pixels into a block and measuring the output current of the driving transistor per block and comparing the output current with a target current.

The modification controller may include an ampere meter measuring the output current of the driving transistor.

The second modification information may be obtained by measuring emitting luminance of the organic light emitting element per block and comparing the emitting luminance with a target luminance.

The luminance of the organic light emitting element per block may be obtained through a photograph of the display panel.

The first modification unit and the second modification unit may respectively include a lookup table.

A method for generating modification information of an organic light emitting device according to an exemplary embodiment of the present invention includes: sequentially supplying a first examination image signal to pixel blocks including a plurality of pixels respectively including a driving transistor and an organic light emitting element; determining an output current of the driving transistor per each pixel block; comparing the output current with a target current; determining first modification information of the input image signal for each pixel block based on a result of the comparison of the output current with the target current; simultaneously supplying a second examination image signal that is separately calculated per each pixel block based on the first modification information and to be uniform for all pixel blocks for the output current of the driving transistor to all pixel blocks; determining a luminance of each pixel block; comparing the luminance with a target luminance; and determining second modified information based on a result of the comparison of the luminance with the target luminance.

The target current may be determined to be more than two per each pixel block, and the supplying number of the first examination image signal and the measuring number of the current is the same as the number of target currents.

The calculating of the first modification information may include calculating first modification information for a limited number of grays of the input image signal from the result of the comparing the output current with a target current, and calculating the first modification information for the remaining grays of the input image signal based on the first modification information for the limited number of grays of the input image signal.

The calculating of the first modification information for the remaining grays of the input image signal may comprises using a lookup table including the gamma curve of the organic light emitting device or an arithmetic equation based on the gamma curve.

The method may further include storing the first modification information to the lookup table.

The measuring of the luminance may comprise using a photographic apparatus or the naked eye.

A modification information generating apparatus of an organic light emitting device including a display panel having a plurality of driving transistors and a plurality of organic light emitting elements according to an exemplary embodiment of the present invention includes: a current device to measure a current of the driving transistor; and a controller to generate first modification information based on the current measured by the current device, and to generate second modification information based on a luminance of the organic light emitting element and the first modification information.

The controller may store the first modification information and the second modification information to different memories of the organic light emitting device, and the organic light emitting device may convert the input image signal into the first modified signal according to the first modification information and into a second modified signal according to the second modification information.

The controller may obtain the first modification information by measuring the output current of the driving transistor and comparing the output current with a target current.

The controller may divide the pixels into blocks, and may obtain the first modification information by measuring the output current of the driving transistor per block and comparing the output current with a target current.

The controller may obtain the second modification information by measuring an emitting luminance of the organic light emitting per block and comparing the emitting luminance with a target luminance.

The luminance of the organic light emitting element per block may be obtained through a photograph of the organic light emitting device.

Accordingly, the characteristic deviation of the organic light emitting device may be reduced without the usage of a compensation circuit per pixel.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE EMBODIMENTS

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art.

It will be understood that when an element or layer is referred to as being "on" or "connected to" another element or layer, it can be directly on or directly connected to the other element or layer, or intervening elements or layers may be present. In contrast, when an element is referred to as being "directly on" or "directly connected to" another element or layer, there are no intervening elements or layers present.

Firstly, an organic light emitting device as one example of a display device according to an exemplary embodiment of the present invention will be described below with reference to FIG. 1, FIG. 2, and FIG. 3.

Figure 1:
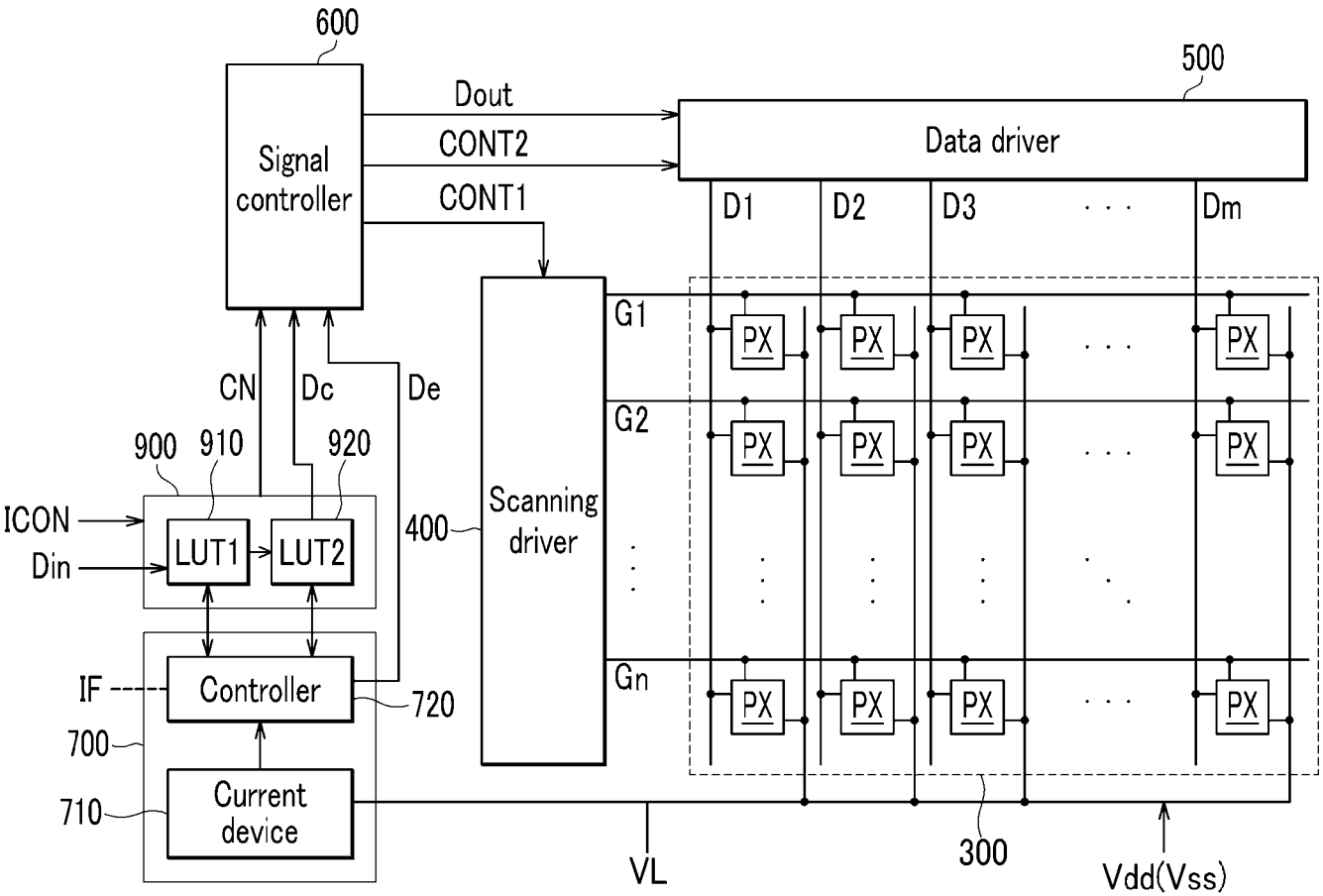
FIG. 1 is a block diagram of an organic light emitting device according to an exemplary embodiment of the present invention.
Figure 2:
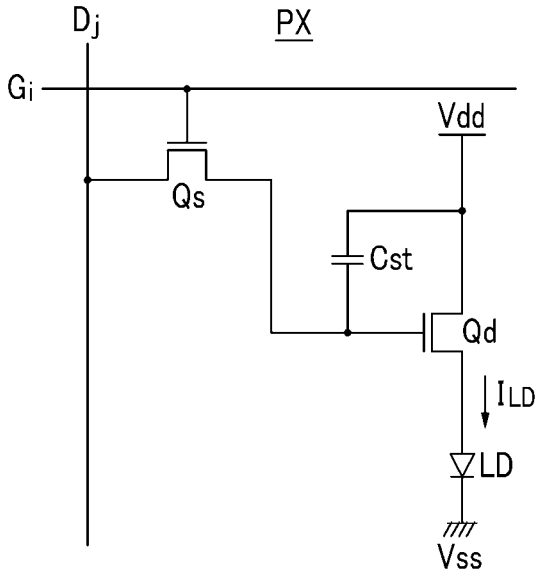
FIG. 2 is an equivalent circuit diagram of one pixel in an organic light emitting device according to an exemplary embodiment of the present invention.

FIG. 1 is a block diagram of an organic light emitting device according to an exemplary embodiment of the present invention, and FIG. 2 is an equivalent circuit diagram of one pixel in an organic light emitting device according to an exemplary embodiment of the present invention.

An organic light emitting device according to an exemplary embodiment of the present invention includes a display panel 300, a scanning driver 400, a data driver 500, a signal controller 600, a modification controller 700, and a signal modification unit 900.

In an equivalent circuit, the display panel 300 includes a plurality of display signal lines G1-Gn and D1-Dm and voltage lines VL, and a plurality of pixels PX that are connected thereto and are arranged in an approximate matrix shape.

The signal lines G1-Gn and D1-Dm include a plurality of scanning lines G1-Gn for transmitting scanning signals, and a plurality of data lines D1-Dm for transmitting data signals, which may be voltages. The scanning lines G1-Gn extend in a row direction and are substantially parallel to each other, and the data lines D1-Dm extend in a column direction and are substantially parallel to each other.

The voltage lines VL transmit a driving voltage Vdd or a common voltage Vss, and may include a plurality of branches extending in a column direction or a row direction.

Each pixel PX, for example the pixel PX connected to the i-th (i=1, 2, . . . , n) scanning line Gi and the j-th (j=1, 2, . . . , m) data line Dj, includes an organic light emitting element LD, a driving transistor Qd, a storage capacitor Cst, and a switching transistor Qs.

The switching transistor Qs is a three-terminal element having a control terminal, an input terminal, and an output terminal. The control terminal is connected to the scanning line Gi, the input terminal to the data line Dj, and the output terminal to the driving transistor Qd. The switching transistor Qs transmits a data voltage applied to the data line Dj in response to a scanning signal applied to the scanning line Gi.

The driving transistor Qd is also a three-terminal element having a control terminal, an input terminal, and an output terminal. The control terminal is connected to the switching transistor Qs, the input terminal to the driving voltage Vdd, and the output terminal to an organic light emitting element LD. The driving transistor Qd outputs an output current $I_{LD}$ depending on a voltage applied between its control terminal and output terminal.

The storage capacitor Cst is connected between the control terminal and the input terminal of the driving transistor Qd. The storage capacitor Cst stores a data voltage applied to the control terminal of the driving transistor Qd and maintains it even after the switching transistor Qs turns off.

The organic light emitting element LD may be an organic light emitting diode (OLED), and it has an anode connected to the output terminal of the driving transistor Qd and a cathode connected to the common voltage Vss. The organic light emitting element LD emits light depending on the output current $I_{LD}$ from the driving transistor Qd, thereby displaying an image.

The organic light emitting element LD includes an organic light emitting member (not shown) for emitting light of one color among primary colors. An example of the primary colors includes three primary colors of red, green, and blue, and desired colors may be displayed by a spatial sum of the three primary colors.

On the other hand, the organic light emitting member may emit white light in all pixels. In this case, color filters (not shown), which vary the white light emitted from the organic light emitting member to one of the primary colors, may be disposed in each pixel. Hereafter, the pixels emitting the light of red, green, and blue are respectively referred to as a red pixel, a green pixel, and a blue pixel.

Furthermore, the pixels PX may include a white pixel for emitting white light. The white pixel includes a white organic light emitting member and does not include a color filter.

The switching transistor Qs and the driving transistor Qd are n-channel field effect transistors (FETs) that may be made of amorphous silicon or poly-crystalline silicon. However, at least one of the switching transistor Qs and the driving transistor Qd may be a p-channel FET. Also, the connection relationship among the transistors Qs and Qd, the capacitor Cst, and the organic light emitting element LD may be modified.

Referring to FIG. 1 again, the scanning driver 400 is connected to the scanning lines G1-Gn in the display panel 300, and it applies scanning signals, which are a combination of a high voltage Von for turning on the switching transistors Qs and a low voltage Voff for turning off the switching transistors Qs, to the scanning lines G1-Gn.

The data driver 500 is connected to the data lines D1-Dm in the display panel 300, and it applies data voltages to the data lines D1-Dm.

The scanning driver 400 and the data driver 500 may be referred to as drivers supplying the driving signals to the display panel 300.

The signal controller 600 controls the scanning driver 400 and the data driver 500.

The signal modification unit 900 converts an input image signal Din into a modified image signal Dc according to predetermined modification information, and it includes a plurality of lookup tables 910 and 920. The signal modification unit 900 may be included in the signal controller 600, and a calculator may be used instead of the first and second lookup tables 910 and 920.

The modification controller 700 fixes the modification information corresponding to the state of the display panel 300 to input them to the first and second lookup tables 910 and 920, and it includes a current device 710 and a controller 720. The current device 710 is connected to the voltage line VL of the display panel 300, thereby detecting the current flowing to the voltage line VL. Here, the current device 710 may be, for example, an ampere meter to measure the current. The controller 720 is connected to the current device 710 and the first and second lookup tables 910 and 920, and may be controlled through an interface IF from the external thereof The modification controller 700 may be attached to the display panel 300 with a chip shape.

An operation of an organic light emitting display will now be described in detail.

The signal modification unit 900 receives an input image signal Din and input control signals ICON from an external graphics controller (not shown) and modifies the input image signal Din to generate a modified image signal Dc. The input image signal Din includes luminance information of each pixel PX as a gray form, and the luminance has a predetermined number of grays, for example 1024(=$2^{10}$), 256(=$2^8$), or 64(=$2^6$) grays. The input control signals ICON include, for example, a vertical synchronization signal, a horizontal synchronization signal, a main clock signal, and a data enable signal.

The modification of the signal modification unit 900 occurs in two steps. The first step is a driving transistor characteristic modification by the first lookup table 910, and the next step is an organic light emitting element characteristic modification by the second lookup table 920.

The signal controller 600 receives the modified image signal Dc and the control signal CN from the signal modification unit 900 to generate scan control signals CONT1 and data control signals CONT2 on the basis thereof, and outputs the scan control signals CONT1 to the scanning driver 400, and the data control signals CONT2 and the output image signal Dout to the data driver 500.

The scanning control signals CONT1 include a scanning start signal STV for instructing to start scanning, and at least one clock signal for controlling the output time of a high voltage Von. The scanning control signals CONT1 may further include an output enable signal OE for defining the duration of the high voltage Von.

The data control signals CONT2 include a horizontal synchronization start signal STH for indicating a start to transmit the digital output image signal Dout for a row of pixels PX, a load signal LOAD for instructing to apply analog data voltages to the data lines D1-Dm, and a data clock signal HCLK.

In response to the data control signals CONT2 from the signal controller 600, the data driver 500 receives the output image signal Dout, and converts the output image signal Dout into analog data voltages.

The scanning driver 400 converts the scanning signal applied to the scanning lines G1-Gn into the high voltage Von in response to the scanning control signals CONT1 from the signal controller 600. Then, data voltages applied to the data lines D1-Dm are transmitted to the corresponding pixels PX through the turned-on switching transistors Qs, and thereby the pixel PX executes the display based on the data voltage.

The data voltage transmitted by the switching transistor Qs is applied to the control terminal of the driving transistor Qd, and the driving transistor Qd outputs the driving current $I_{LD}$ corresponding to the applied data voltage to the organic light emitting element LD. Then, the organic light emitting element LD emits light having an intensity corresponding to the output current $I_{LD}$.

By repeating this procedure by a unit of 1 horizontal period (which is also denoted as "1H" and is equal to one period of the horizontal synchronization signal Hsync and the data enable signal DE), all scanning lines G1-Gn may be sequentially supplied with the high voltage Von, thereby applying data voltages to all pixels PX to display an image for a frame.

In the organic light emitting device executing the display operation, the spatial and temporal characteristic deviations of the driving transistors Qd or the organic light emitting elements LD deteriorate, and the display quality degradation may appear in spite of the modification of the signal modification unit 900.

In this case, the modification information stored in the signal modification unit 900 may be renewed by using the modification controller 700 that is controlled by external control through the interface IF.

Next, this process will be described in detail with reference to FIG. 3 to FIG. 14.

Figure 5:
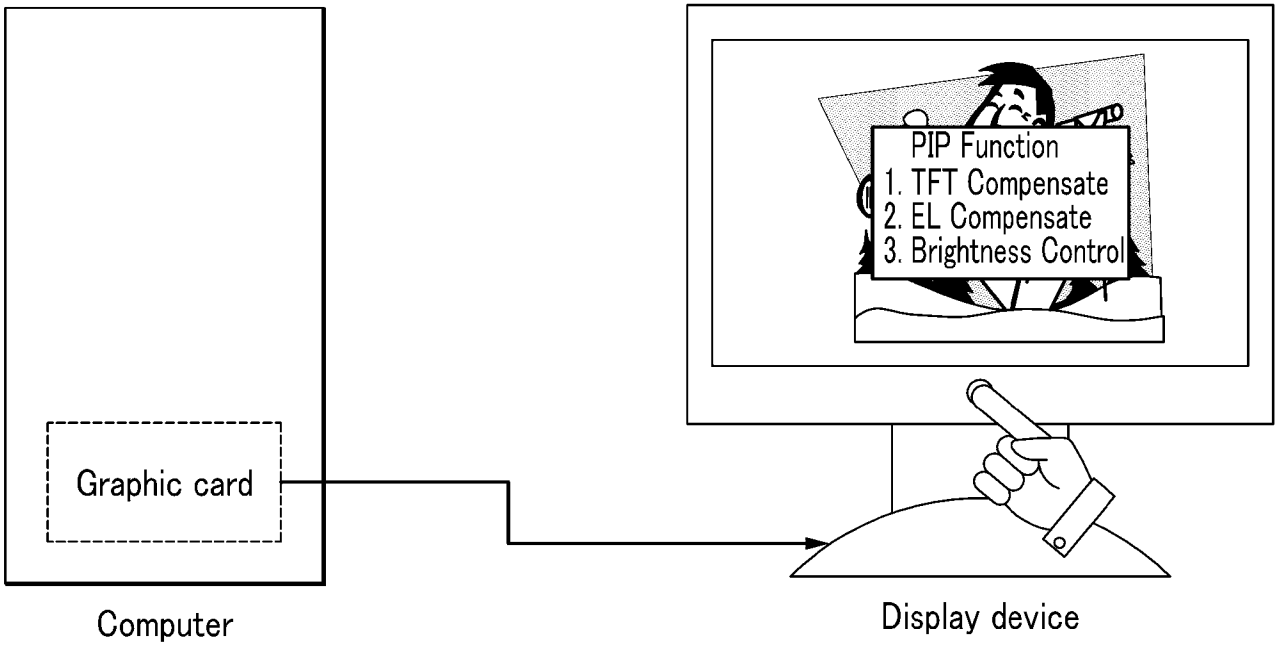
Figure 6:
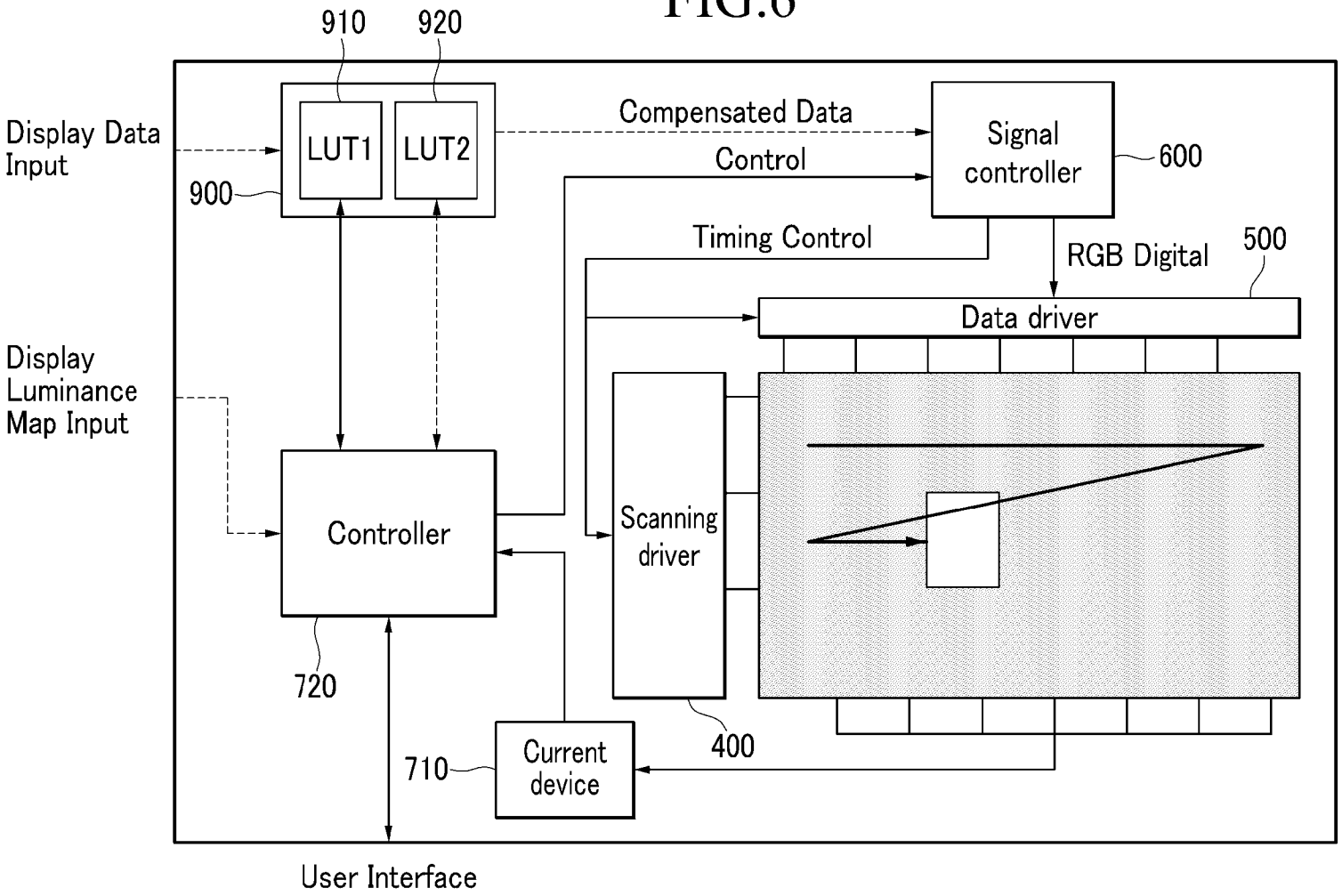
Figure 7:
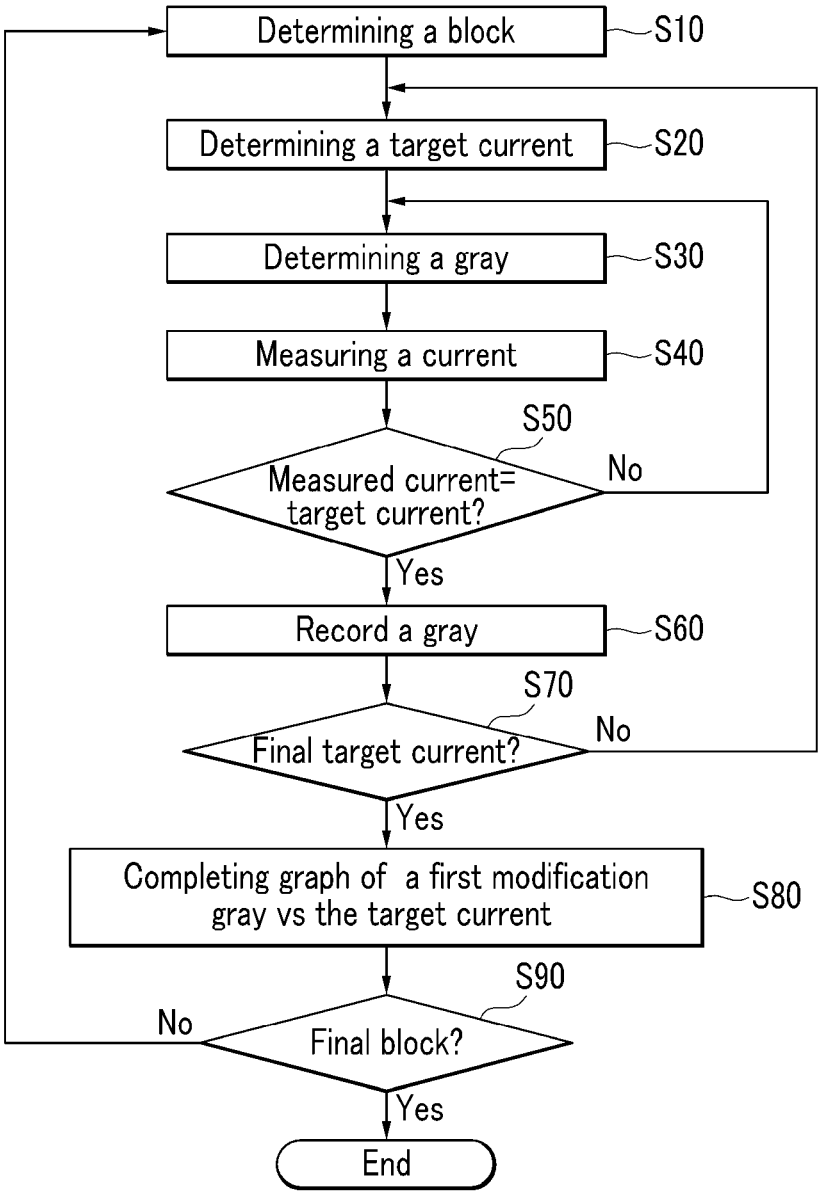
FIG. 7 is a flowchart showing a process refreshing modification information of a driving transistor characteristic deviation in an organic light emitting device according to an exemplary embodiment of the present invention.
Figure 8:
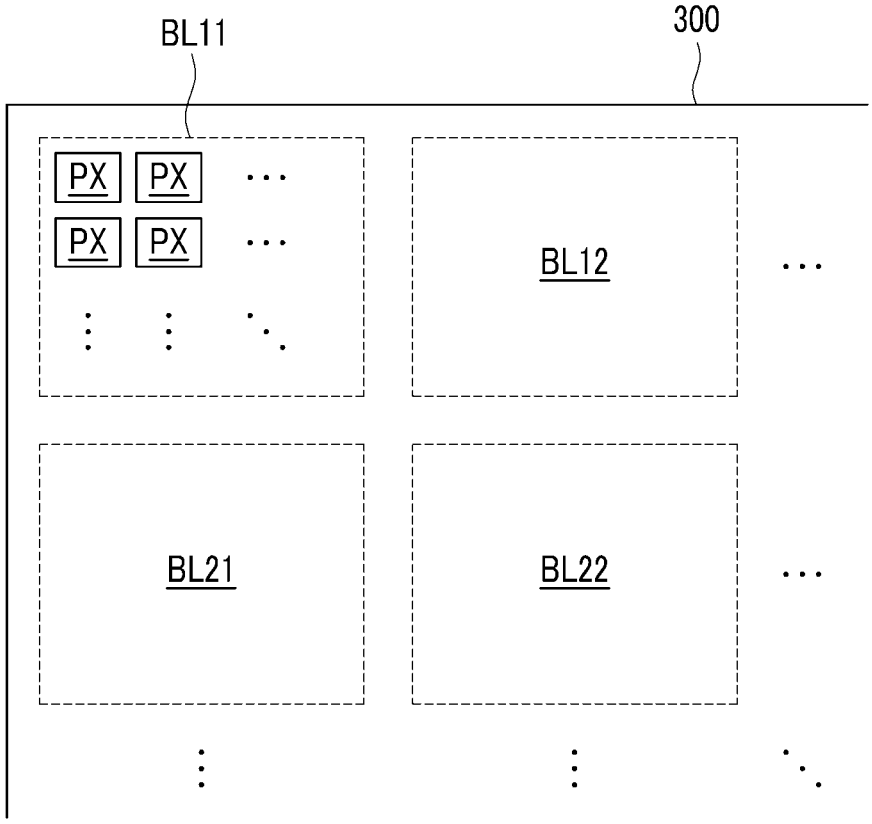
FIG. 8 is a view for explaining a method for grouping pixels of the display panel to execute the process of refreshing modification information shown in FIG. 7.
Figure 9:
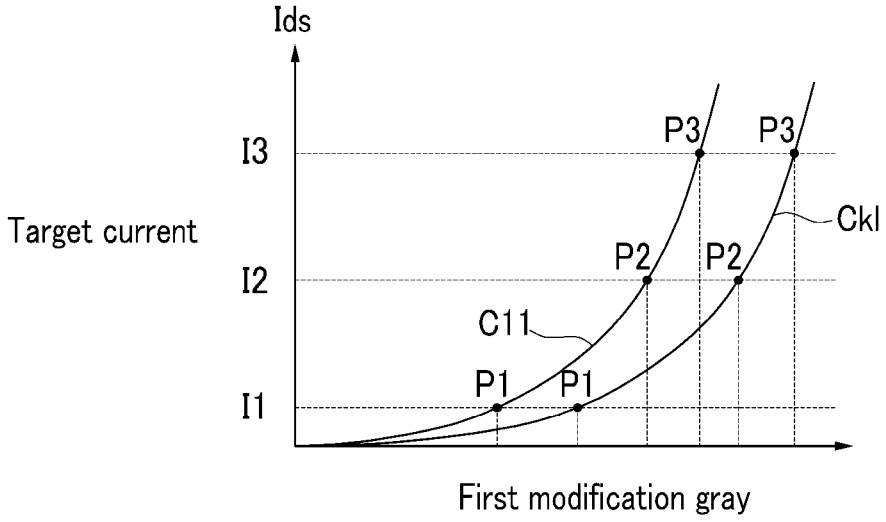
FIG. 9 is a graph explaining the process of refreshing modification information shown in FIG. 7.
Figure 12:
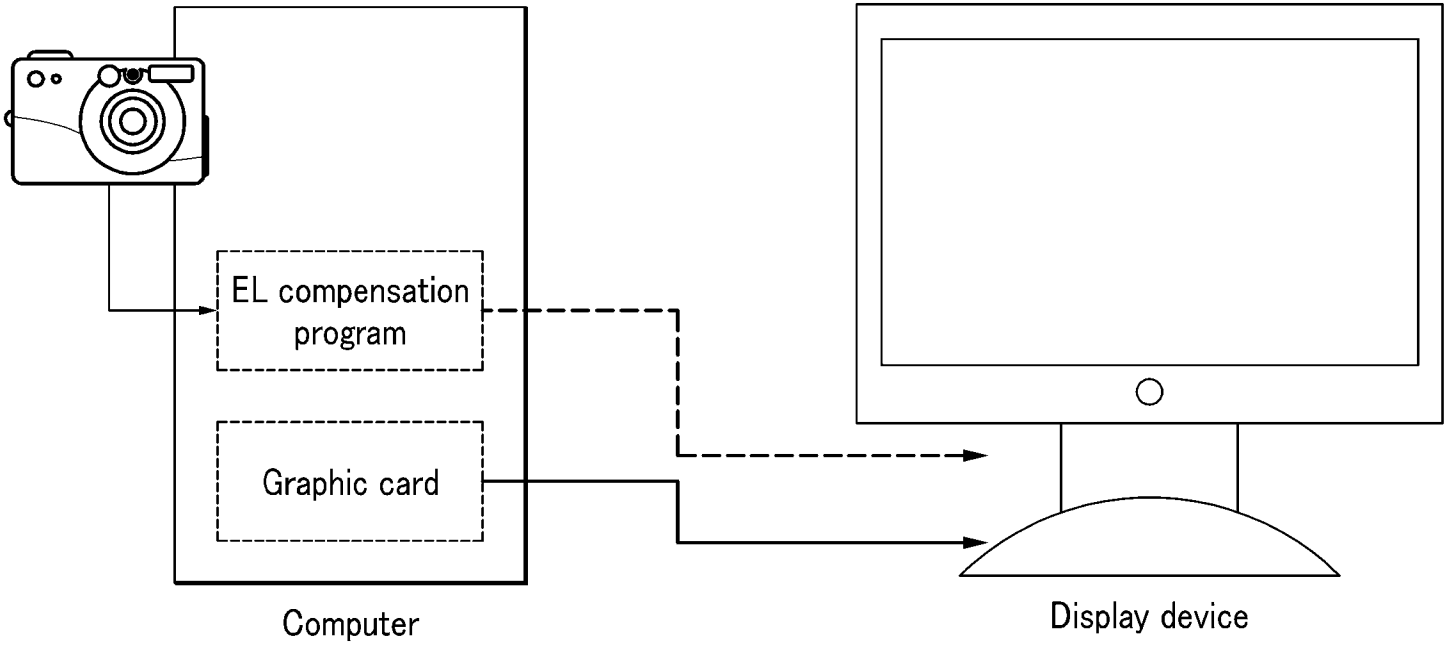
Figure 13:
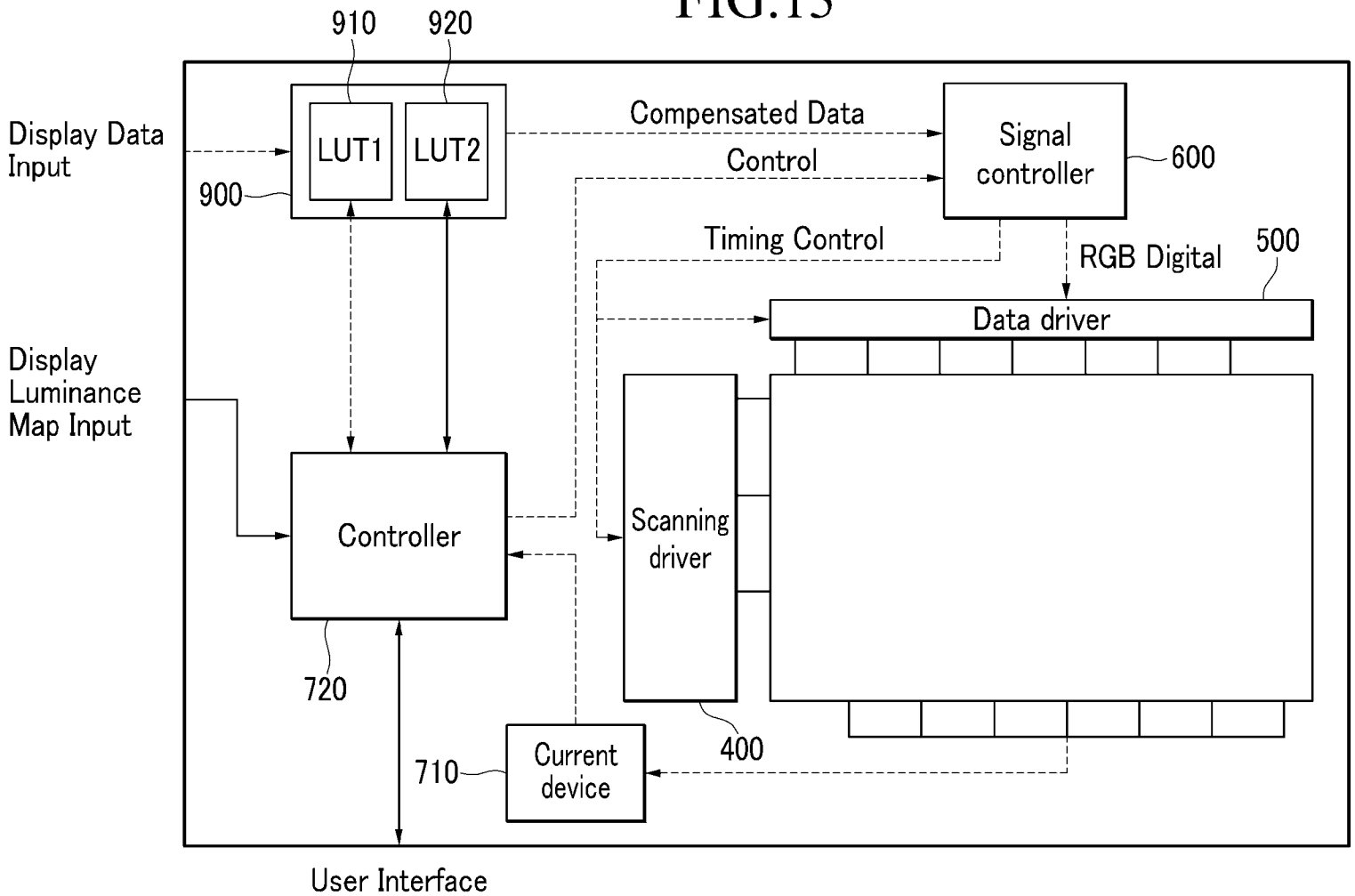
Figure 14:
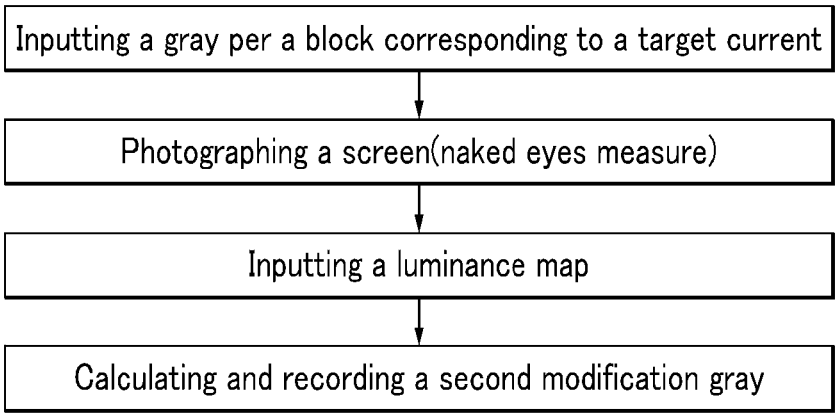
FIG. 14 is a flowchart showing a process of refreshing modification information of an organic light emitting element characteristic deviation in an organic light emitting device according to an exemplary embodiment of the present invention.

FIG. 3, FIG. 4, FIG. 5, and FIG. 6 are schematic views showing a process of refreshing modification information of a driving transistor characteristic deviation in an organic light emitting device according to an exemplary embodiment of the present invention, FIG. 7 is a flowchart showing a process of refreshing modification information of a driving transistor characteristic deviation in an organic light emitting device according to an exemplary embodiment of the present invention, FIG. 8 is a view for explaining a method for grouping pixels of the display panel to execute the process of refreshing modification information shown in FIG. 7, FIG. 9 is a graph explaining the process of refreshing modification information shown in FIG. 7, FIG. 10, FIG. 11, FIG. 12, and FIG. 13 are schematic views showing a process of refreshing modification information of an organic light emitting element characteristic deviation in an organic light emitting device according to an exemplary embodiment of the present invention, and FIG. 14 is a flowchart showing a process of refreshing modification information of an organic light emitting element characteristic deviation in an organic light emitting device according to an exemplary embodiment of the present invention.

Figure 3:
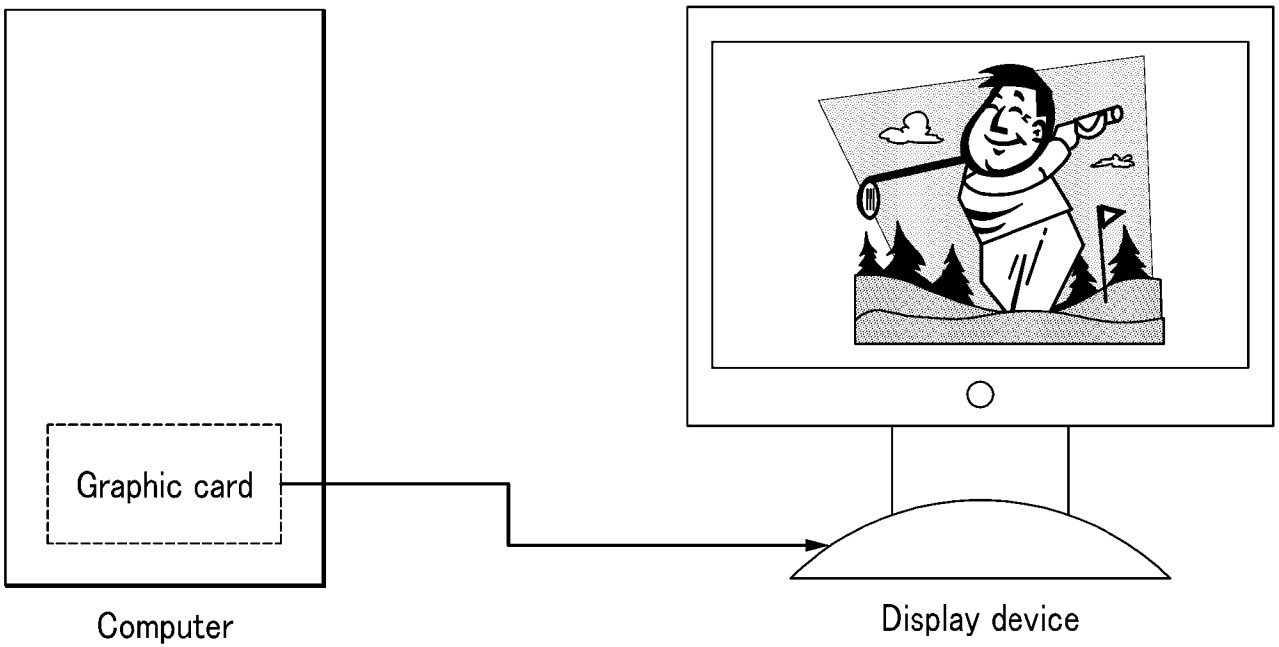
FIG. 3, FIG. 4, FIG. 5, and FIG. 6 are schematic views showing a process of refreshing modification information of a driving transistor characteristic deviation in an organic light emitting device according to an exemplary embodiment of the present invention.
Figure 4:
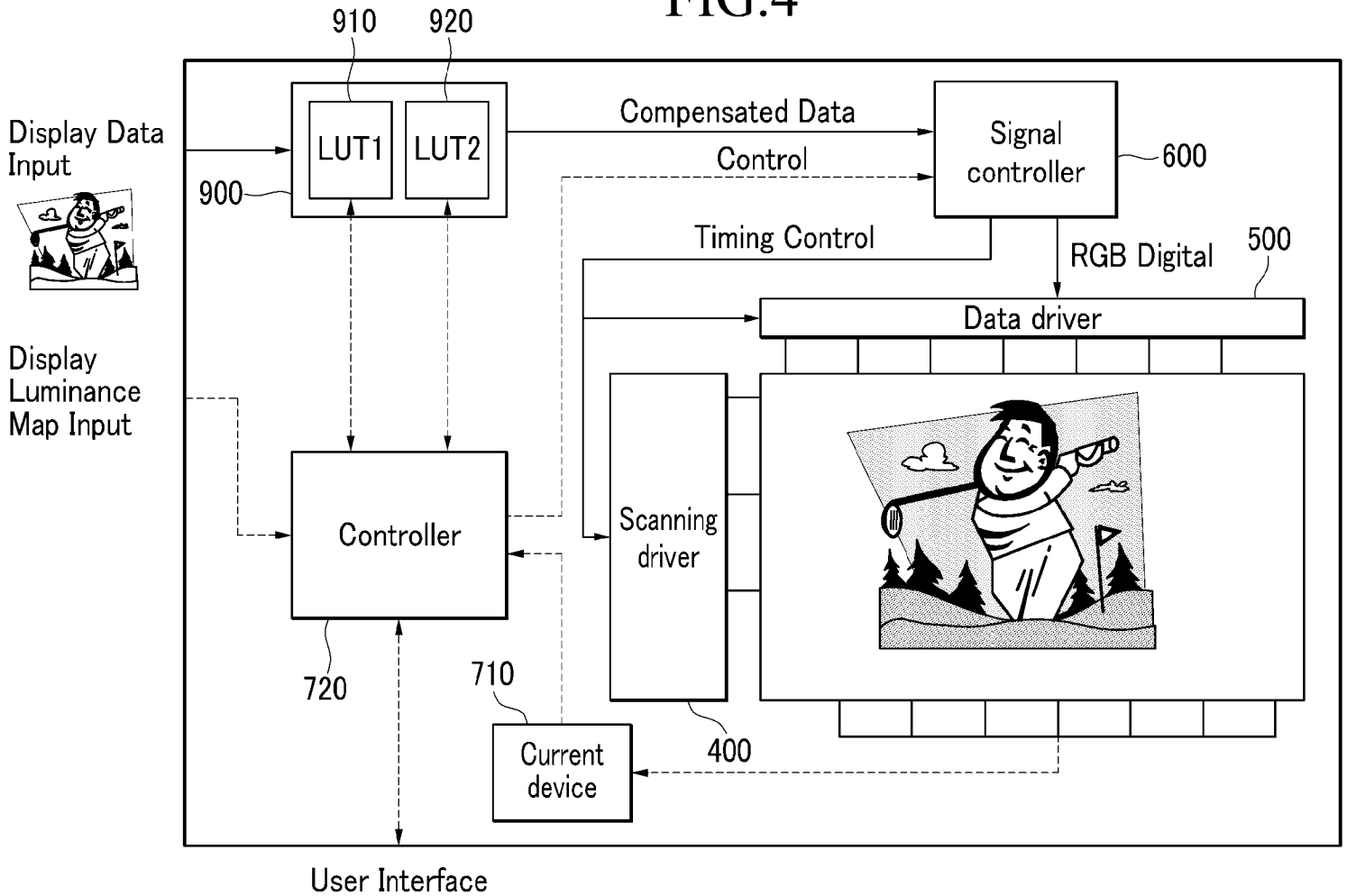

As shown in FIG. 3 and FIG. 4, if the image signal (Display Data) is input to the display device through a graphics card of the computer, the input image signal is converted into a compensation image signal in the signal modification unit 900 and is input to the signal controller 600. The signal controller 600 generates a scan control signal and a data control signal based on the compensated image signal and the control signal to respectively output them to the scan driver 400 and the data driver 500, thereby displaying the images.

As shown in FIG. 5, a user having the refreshing necessity of the modification information makes the controller 720 of the modification controller 700 into a refreshing mode of the modification information through the interface IF provided to the display device. Next, the controller 720 controls the signal modification unit 900 and the signal controller 600 to execute the refreshing process of the modification information. For this refreshing process of the modification information, the programs stored in the controller 720 may be substantially executed through a simple comment of the user, or the user may intervene in the middle of a process to manually generate the wanted modification information.

The modification information refreshing process is divided into a modification information refreshing process (TFT Compensate) of the driving transistor Qd characteristic deviation and a modification information refreshing process (EL Compensate) of the organic light emitting element LD characteristic deviation, and may include brightness control of the display device. The modification information refreshing process of the driving transistor Qd characteristic deviation may be firstly executed, and the modification information refreshing process of the organic light emitting element LD characteristic deviation may be executed based on the result of the modification information refreshing process of the driving transistor Qd characteristic deviation.

The modification information refreshing principles of the characteristic deviation of the driving transistor Qd and organic light emitting element LD according to an exemplary embodiment of the present invention are as follows.

As above described, the gray of the input image signal Din represents the luminance of the pixel PX. In the organic light emitting device, the input image signal Din is changed into the data voltage and applied to the pixel PX. The data voltage is changed into the output current $I_{LD}$ of the driving transistor Qd, and the output current $I_{LD}$ is changed into the intensity of light through the organic light emitting element LD, that is, the luminance of the pixel PX.

Accordingly, the process in which the input image signal Din is changed into the luminance of the pixel PX depends on the characteristics of the driving transistor Qd and the organic light emitting element LD.

The characteristic deviation of the driving transistor Qd may be determined by detecting the output of the output current $I_{LD}$ when the same arbitrary data voltages are applied to the driving transistors Qd. The data voltages correspond one-to-one to the input image signals Din such that the characteristic deviation of the driving transistor Qd may be confirmed by detecting the output current $I_{LD}$ of the driving transistor Qd after inputting the same input image signals Din to each pixel PX.

The characteristic deviation of the organic light emitting element LD may be determined by detecting whether the intensities of the light emitted from the organic light emitting element LD are the same when the output currents $I_{LD}$ of the driving transistors Qd are the same. If there is no characteristic deviation of the driving transistor Qd, the output currents $I_{LD}$ are the same when inputting the same input image signals Din to each pixel PX. Accordingly, if the intensity of the light output from each pixel PX is detected after removing the characteristic deviation of the driving transistor Qd, it may be determined whether the characteristic deviation of the organic light emitting element LD is generated.

Next, the modification information refreshing process of the characteristic deviations of the driving transistor Qd and organic light emitting element LD according to an exemplary embodiment of the present invention will be described in detail.

Firstly, the modification information refreshing process of the driving transistor Qd characteristic deviation will be described in detail.

Referring to FIG. 7 and FIG. 8, firstly, the display panel 300 is divided into a plurality of blocks (BL11, BL12, . . . , BL21, BL22, . . . ) (hereafter, the reference numeral is referred to as "BL") (S10). One block BL includes a plurality of pixels PX, and the number and positions thereof may be changed if necessary.

Next, a target current is determined for a limited number of grays (S20). The emitting intensity of the organic light emitting element LD targeted by the gray of the input image signal Din may be determined, and the standard value of the output current $I_{LD}$ of the driving transistor Qd that provides the emitting intensity may be determined for the display panel 300. Accordingly, this standard value may be determined as the target current.

The target current may be determined for all grays. But because this takes a long time, the target current may be determined for a limited number of grays (S30). For example, three grays may be determined one by one among a lower gray, a middle gray, and a high gray. The thus-determined grays are respectively referred to as the first reference gray, the second reference gray, and the third reference gray, and the target currents thereof are respectively referred to as the first target current I1, the second target current I2, and the third target current I3.

Referring to FIG. 6, FIG. 7, and FIG. 8, if the user selects the modification information refreshing process (TFT Compensate) of the driving transistor Qd characteristic deviation through the interface IF, the driving transistor modification program stored in the modification controller 700 operates to carry out the following procedures.

For the first block BL11, the first examination image signal De is firstly input, and the current is measured by using the current device 710 (S40). The current device 710 is connected to the voltage line VL of FIG. 1, and the voltage line VL may be a voltage line transmitting the driving voltage Vdd or a voltage line transmitting the common voltage Vss. If the leakage current is ignored, the current detected by the current device 710 is the current that flows through the driving transistor Qd and the organic light emitting element LD regardless of whether the voltage transmitted through the voltage line VL is the driving voltage Vdd or the common voltage Vss.

When the branches of the voltage line VL are extended one by one per each pixel column according to the pixel column as FIG. 1, for example if one block BL includes one pixel column, the value that results when the measured current is divided by the number of pixels PX included in the pixel column is the average current of the driving transistor Qd of the pixels PX included in the block BL. On the contrary, when one block BL includes one pixel row, the value that results when the measured current is divided by the number of pixels PX is the average current of the driving transistor Qd of the pixels PX included in the block BL. Therefore, as shown in FIG. 8, when the block BL includes a plurality of pixel rows and a plurality of pixel columns, the value that results when the measured current is divided by the number of pixels PX is the average current of the driving transistor Qd of the pixels PX.

When the branches of the voltage line VL are extended in the row direction, it is opposite to the above-described explanation. That is, the explanation that the column and the row are exchanged in the previous explanation corresponds to this case.

The gray of the first examination image signal De may start as the same gray as the first reference gray.

The measured current and the first target current I1 are compared with each other (S50), and if the measured current is the same as the first target current I1, the gray of the first examination image signal De is written as the first modified gray (S60). For example, when the difference between the measured current and the first target current I1 is less than 10% of the current difference between the gray and its neighboring grays, then the measured current may be determined to be the same as the first target current I1. If the measured current is different from the first target current I1, the gray of the first examination image signal De is changed. For example, the gray of the first examination image signal De may be raised and lowered by one level for the first reference gray. By repeatedly changing the gray S30, measuring the current S40, and comparing the measured current with the first target current I1 S50, the gray of the first examination image signal De is detected and written as the first modified gray at the point when the measured current is the same as the first target current I1.

Next, the second examination image signal De is input, and the current measurement S40 and the comparison S50 with the second target current I2 are repeated as necessary as the gray level changes such that the gray of the first examination image signal De is detected and written as the first modified gray at the point when the measured current is the same as the second target current I2. Here, the gray of the second examination image signal De may start as the same gray as the second reference gray.

Finally, the same process is repeated for the third examination image signal De such that the gray of the third examination image signal De is detected and written as the first modified gray at the point when the measured current is the same as the third target current I3 (S70).

Thus, three positions P1, P2, and P3 of the curved line C11 shown in FIG. 9 may be found. Based on the thus-found three positions P1, P2, and P3, the arithmetic equation associated with the gamma curve of the display panel 300 or the lookup table including the gamma curve are referred to, and thereby the curved line C11 showing the relationship between the target current and the first modified gray is completed (S80).

A curved line Ckl (k and l are integers) showing the relationship between the target current and the first modified gray is also completed for the remaining blocks BL through the same process as for the first block BL11 (S90).

The target current and the reference gray have a one-to-one correspondence such that the curved lines of FIG. 9 may be changed into the curved line showing the relation between the reference gray and the modified grays, as a result, the thus-determined curved line is stored in the first lookup table 910. Then, if the input image signal Din of the same gray passes through the first lookup table 910 for all blocks and is output to the signal controller 600, the average output currents $I_{LD}$ of the driving transistors Qd included in all blocks BL may become the same.

Next, the refreshing process of the characteristic deviation modification information of the organic light emitting element LD will be described.

Figure 10:
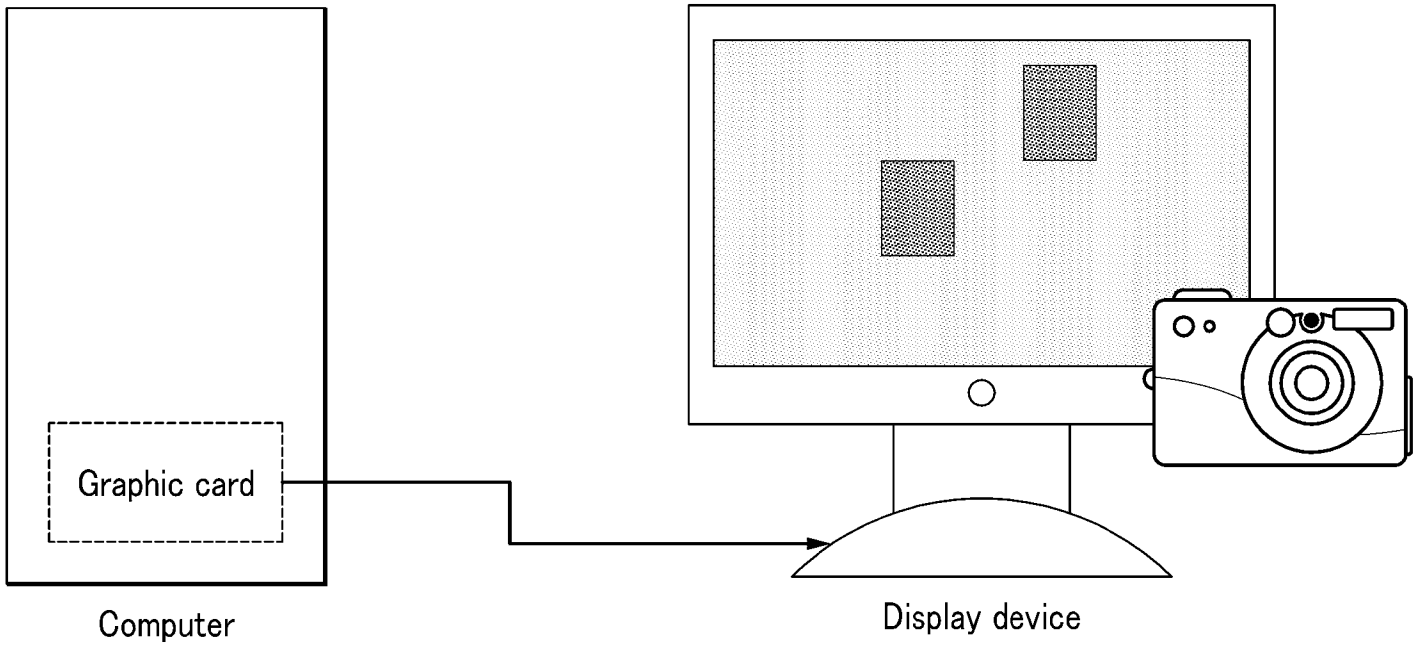
FIG. 10, FIG. 11, FIG. 12, and FIG. 13 are schematic views showing a process of refreshing modification information of an organic light emitting element characteristic deviation in an organic light emitting device according to an exemplary embodiment of the present invention.
Figure 11:
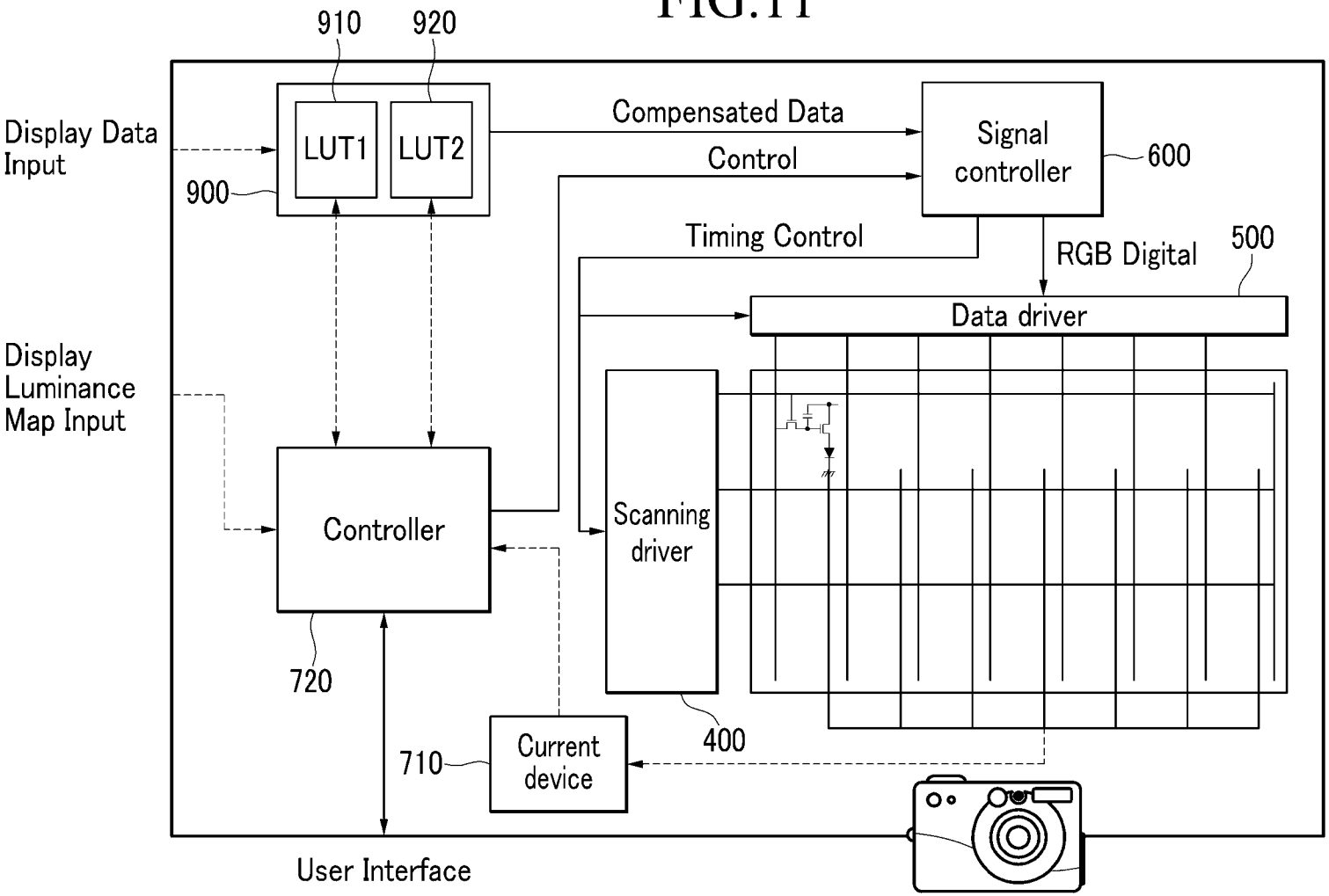

Referring to FIG. 10 and FIG. 11, if the user selects the modification information refreshing process (EL Compensate) of the characteristic deviation of the organic light emitting element LD through the interface IF, the image by the modified compensation image signal for the same current to be flowed through the first lookup table 910 is displayed in the screen of the display device. Here, the target luminance with which the characteristic deviation of the organic light emitting element LD is best represented and the target current corresponding thereto are determined, and the examination image signal De is output to all blocks BL thereby emitting all blocks BL at the same time. Here, the gray of the examination image signal De is the first modified gray for giving the previously determined target current, and may be different for each of the blocks BL. Thus, a stain due to the characteristic deviation of the organic light emitting element LD may appear on the screen, as shown in FIG. 10. In this state, the screen of the display panel 300 may be photographed through a photographing apparatus such as a digital camera.

Next, referring to FIG. 12 and FIG. 13, the photograph of the screen that is taken through the photographing apparatus is transmitted to a computer, and the characteristic deviation compensation program (EL compensation program) of the organic light emitting element LD installed in the computer is operated to make the luminance per block into a display luminance map. Based on the display luminance map by block, the second modified gray for each block is detected with reference to the arithmetic equation associated with the gamma curve of the display panel 300 or the lookup table including the gamma curve, and is stored to the second lookup table 920 through the function of the first modified gray. For a block for which the target luminance is not represented, the gray value for representing the target luminance is detected and stored as the second modified gray, and the first modified gray is stored as the second modified gray as it is for the block for which the target luminance is represented.

Here, the characteristic deviation compensation program (EL compensation program) of the organic light emitting element LD may be installed to the controller 720 of the display device, instead of the separate computer. Also, the work in which the second modified gray for each block is detected with reference to the arithmetic equation associated with the gamma curve of the display panel 300 or the lookup table including the gamma curve based on the a display luminance map by block may be executed by the separate computer, and the controller 720 of the display device may only execute the function in which the controller 720 receives the detected second modified gray and stores it to the second lookup table 920.

The photographing apparatus used in this process may be a special photographing apparatus for the modification. However, the luminance data for the block may be obtained by the method in which the screen is photographed by the digital camera of the user and input to the controller 720. As an alternative to using the separate photographing apparatus, the program of the controller 720 for determining a block having a difference of luminance through the naked eye and manually or automatically controlling the luminance of the corresponding block may be made. For example, the luminance of the block may be manually controlled through a method in which a block having a defect is selected by a user, and the user physically pushes a button of the display device or clicks a button represented on the screen to change the luminance of the block to the desired level. In this case, the second modified gray is determined by the value that the user sees and determines as the target luminance. On the other hand, if the block is selected, the program may automatically control the luminance.

Thus, the input image signal Din is firstly modified through the first lookup table 910, and is passed through the second lookup table 920 for the secondary modification such that the block BL may display the wanted luminance.

This process refreshes the modification information, and may be used when the modification information is firstly recorded to the first and second lookup tables 910 and 920 of the signal modification unit 900 before providing the product. In this case, the modification controller 700 may be separated from the organic light emitting device and may be separately provided.

The above-described method may be applied to other display devices as well as the organic light emitting device.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. An organic light emitting device, comprising:

a display panel comprising pixels, the pixels comprising driving transistors and organic light emitting elements;

a driving unit to supply a driving signal to the display panel;

a signal controller to control the driving unit;

a signal modification unit to modify an input image signal based on modification information to generate a modified image signal; and a modification controller to generate and provide the modification information to the signal modification unit, wherein the signal modification unit comprises:

a first modification unit to convert the input image signal into a first modified signal according to first modification information to compensate for deviation in output currents of the driving transistors so that the output currents are substantially uniform for a same input image signal; and a second modification unit to convert the first modified signal into the modified image signal according to second modification information to compensate for deviation in luminance of the organic light emitting elements so that luminance of the organic light emitting elements is substantially uniform for the first modified signal to make the output currents of the driving transistors substantially uniform for different pixels.

2. The organic light emitting device of claim 1, wherein the first modification information is obtained by measuring the output currents of the driving transistors and comparing the output currents with a target current.

3. The organic light emitting device of claim 1, wherein the first modification information is obtained by grouping pixels into a block and measuring an output current of the driving transistors per block and comparing the output current with a target current.

4. The organic light emitting device of claim 3, wherein the modification controller comprises an ampere meter to measure the output current of the driving transistors per block.

5. The organic light emitting device of claim 3, wherein the second modification information is obtained by measuring an emitting luminance of the organic light emitting elements per block and comparing the emitting luminance with a target luminance.

6. The organic light emitting device of claim 5, wherein the luminance of the organic light emitting elements per block is obtained using an image of the display panel.

7. The organic light emitting device of claim 1, wherein the first modification unit and the second modification unit each comprise a lookup table.

8. A method for generating modification information of an organic light emitting device, comprising:

sequentially supplying a first examination image signal to pixel blocks comprising a plurality of pixels, each pixel comprising a driving transistor and an organic light emitting element;

determining an output current of the driving transistor per each pixel block;

comparing the output current with a target current;

determining first modification information of the input image signal for each pixel block based on a result of the comparison of the output current with the target current;

simultaneously supplying a second examination image signal to all pixel blocks, the second examination image signal being separately calculated per each pixel block based on the first modification information and making the output current of the driving transistor uniform for all pixel blocks;

determining a luminance of each pixel block;

comparing the luminance with a target luminance; and determining second modified information based on a result of the comparison of the luminance with the target luminance.

9. The method of claim 8, wherein more than two target currents are determined per each pixel block, and the first examination image signal is supplied, and the output current is determined, for the same number of times as the number of target currents per each pixel block.

10. The method of claim 9, wherein determining the first modification information comprises:

determining the first modification information for a limited number of grays of the input image signal from the result of the comparison of the output current with the target current; and calculating the first modification information for the remaining grays of the input image signal based on the first modification information determined for the limited number of grays of the input image signal.

11. The method of claim 10, wherein calculating the first modification information for the remaining grays of the input image signal comprises using a lookup table including a gamma curve of the organic light emitting device or an arithmetic equation based on the gamma curve.

12. The method of claim 11, further comprising storing the first modification information to the lookup table.

13. The method of claim 8, wherein determining of the luminance of each pixel block comprises using a photographing apparatus.

14. The method of claim 8, wherein determining the luminance of each pixel block comprises using a naked eye.

15. A modification information generating apparatus for an organic light emitting device comprising a display panel comprising driving transistors and organic light emitting elements, the apparatus comprising:

a current device to measure the output currents of the driving transistors; and a controller to generate first modification information based on the output currents measured by the current device, and to generate second modification information based on luminance of the organic light emitting elements and the first modification information, wherein the first modification information is for compensating deviation in the output currents of the driving transistors so that the output currents are substantially uniform for a same input image signal, and wherein the second modification information is for compensating deviation in luminance of the organic light emitting elements so that luminance of the organic light emitting elements is substantially the same for the first modified signal to make the output currents of the driving transistors substantially uniform for different pixels.

16. The modification information generating apparatus of claim 15, wherein:

the controller stores the first modification information and the second modification information to different memories of the organic light emitting device, and the organic light emitting device converts an input image signal into a first modified signal according to the first modification information and converts the first modified signal into a second modified signal according to the second modification information.

17. The modification information generating apparatus of claim 15, wherein the controller obtains the first modification information by comparing the output currents measured by the current device with a target current.

18. The modification information generating apparatus of claim 15, wherein the controller divides the pixels into blocks and the current device measures the output current of the driving transistors per block, and the first modification information is obtained by comparing the current measured by the current device with a target current.

19. The modification information generating apparatus of claim 18, wherein the controller obtains the second modification information by determining a luminance of the organic light emitting elements per block and comparing the luminance with a target luminance.

20. The modification information generating apparatus of claim 19, wherein the luminance of the organic light emitting elements per block is obtained using an image of the organic light emitting device.

21. The organic light emitting device of claim 1, wherein the first modification unit comprises a first memory configured to store the first modification information corresponding to a relation between reference grays and first modification grays, and the second modification unit comprises a second memory configured to store the second modification information corresponding to a relation between the first modification grays and second modification grays.

22. The method of claim 8, further comprising:

storing the first modification information in a first memory; and storing the second modification information in a second memory, wherein the first modification information corresponds to a relation between reference grays and first modification grays, and the second modification information corresponds to a relation between the first modification grays and second modification grays.

23. The modification information generating apparatus of claim 15, wherein the controller is configured to store the first modification information in a first memory and the second modification information in a second memory, and wherein the first modification information corresponds to a relation between reference grays and first modification grays, and the second modification information corresponds to a relation between the first modification grays and second modification grays.

* * * * *